US006383098B1

(12) United States Patent
Haumschilt et al.

(10) Patent No.: US 6,383,098 B1
(45) Date of Patent: May 7, 2002

(54) FOOT DEVICE TO STRIKE A BALL

(76) Inventors: Kevin Allen Haumschilt; Kenneth Joseph Haumschilt, both of 14801 Morningside Dr., Poway, CA (US) 92064

( * ) Notice: Subject to any disclaimer, the term of this patent is extended or adjusted under 35 U.S.C. 154(b) by 0 days.

(21) Appl. No.: 09/586,055

(22) Filed: Jun. 2, 2000

Related U.S. Application Data

(60) Provisional application No. 60/137,070, filed on Jun. 2, 1999.

(51) Int. Cl.[7] ..... A63B 49/00
(52) U.S. Cl. ..... 473/518; 273/DIG. 18
(58) Field of Search ..... 473/516, 518, 473/527, 524, 526, 528, 543, 532, 534; 273/DIG. 18

(56) References Cited

U.S. PATENT DOCUMENTS

| | | | | | |
|---|---|---|---|---|---|
| 1,637,278 | A | * | 7/1927 | Renz | 273/DIG. 18 X |
| 2,852,967 | A | * | 9/1958 | Wagner et al. | 473/518 X |
| 3,091,460 | A | * | 5/1963 | Maldonado | 473/518 |
| 3,516,668 | A | * | 6/1970 | Kirk | 473/518 |
| 3,628,794 | A | * | 12/1971 | Conture | 273/DIG. 18 X |
| 4,718,676 | A | * | 1/1988 | Collins, Jr. | 273/DIG. 18 X |
| 5,080,371 | A | * | 1/1992 | Karczewski | 273/DIG. 18 X |
| 6,257,998 | B1 | * | 7/2001 | Ein-Gal | 473/518 |

FOREIGN PATENT DOCUMENTS

| | | | | |
|---|---|---|---|---|
| FR | 2770412 | * | 5/1999 | |
| GB | 11965 | * | 5/1911 | 473/FOR 178 |
| GB | 204113 | * | 9/1923 | 473/FOR 185 |
| JP | 10-118232 | * | 10/1996 | |
| WO | 92/13605 | * | 2/1992 | |

* cited by examiner

*Primary Examiner*—Raleigh W. Chiu
(74) *Attorney, Agent, or Firm*—Sonnenschein Nath & Rosenthal

(57) ABSTRACT

The invention includes a foot device to strike a projectile, such as a footbag. The foot device includes a frame, an elastic material and a base, where the elastic material and the base are attached to the frame. The elastic material is adapted to strike the projectile and to extend while exerting tension on the frame. Moreover, the base is adapted to be coupled to a shoe without restricting the motion of a foot within the shoe.

20 Claims, 5 Drawing Sheets

FIG. 1
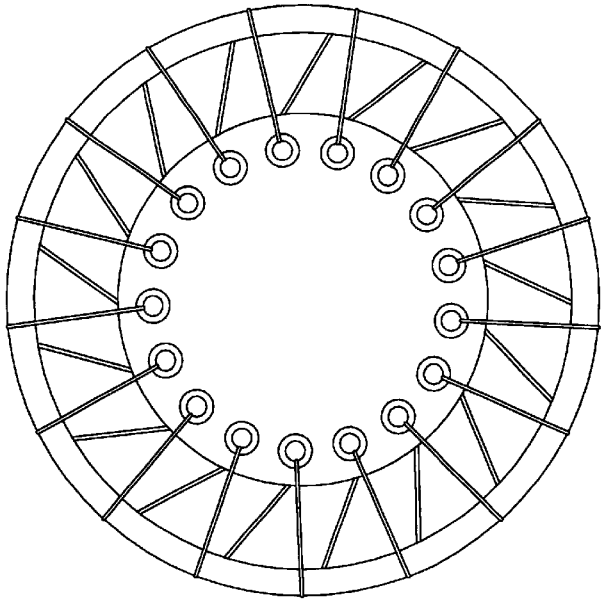
FIG. 2
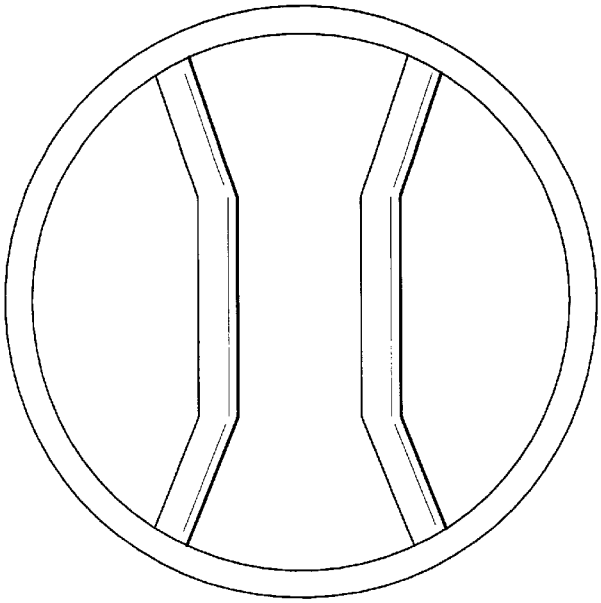
FIG. 4
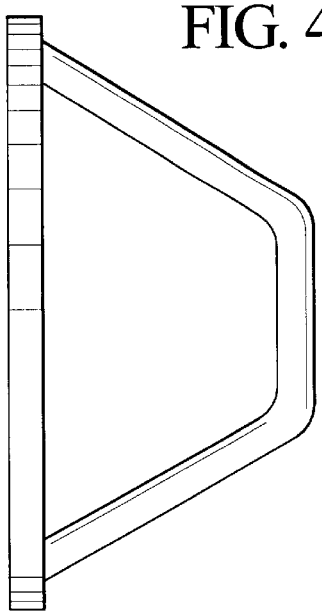
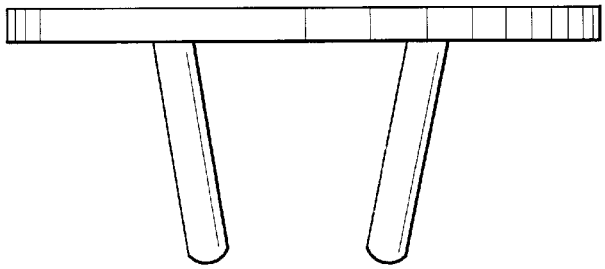
FIG. 3

FOOT DEVICE TO STRIKE A BALL

This patent claims priority benefits to U.S. Provisional Patent Application No. 60/137,070 having the filing date of Jun. 2, 1999.

BACKGROUND

1. Field of Invention

This invention relates to a new custom-designed foot racquet sports toy to increase play, but not limited to the play, and action for the sport of footbag.

2. Related Information

The game of kicking a small footbag filled with plastic pellets has become an American sport of leisure for many young men and women between the ages of 10 and 25. The skill level required for advanced play is difficult to master. These skills require very well developed full body motion control and considerable foot and leg coordination to actively participate. Play has historically been repetitious and monotonous. Many good to advanced players lose interest after only a few sessions.

Footbag play has been internationally recognized as a sport and has a website designated for the registration of active footbag clubs. The website is www.footbag.org. There are several hundred active footbag clubs worldwide with thousands of registered members. The clubs help promote advanced play and sportsmanship through nationally recognized championship freestyle play complete with official rules and a governing board to regulate play.

There are not currently any foot racquets available. One reason for this may be that the human foot via the toes is not capable of grasping a racquet by the foot without some sort of attachment device. There is a large variety of hand held racquets, but not a single reference to foot racquet design could be found, due in part to the seemingly impossible idea of grasping a racquet with toes. Thus, what is needed is a foot racquet that attaches, for example, via the shoelaces of a standard laceable tennis shoe.

SUMMARY OF THE INVENTION

A human foot does not have an opposing thumb style appendage which enables a human being to grasp a racquet by the foot. A human foot has no intuitive way for a human being to grasp and use a racquet with the foot and leg. Thus, the idea of attaching a racquet to the foot is not obvious to launch a projectile. No prior art exists to demonstrate a similar or existing model for comparison. In one embodiment, this invention presents a foot racquet that attaches via the shoelaces of a standard laceable shoe such as a tennis shoe.

When used as a sports toy, the foot racquet of the invention may be used with a foot bag or other small sports ball. Conventionally, a high flying, extremely fast playing action is not currently available to a player kicking a footbag without the use of a foot racquet device. The foot racquet design was conceived to increase the playing height and action of the sport of footbag. Although not fully restricted to the sport of footbag, the sport of footbag is an ideal frame of reference to introduce this innovative sports toy. The racquet design allows a person with lower skill levels to participate in play. The action off the "mini-trampoline design" also allows more advanced players the option of super high kicking action.ng a footbag without the use of a foot racquet device.

The invention includes a racquet style mini trampoline designed for attachment to a standard tennis shoe via the shoelaces. The foot racquet allows for a controlled kicking action that allows a player to project a ball or footbag further than with a conventional shoe kicking action.

Accordingly, the invention works towards achieving the following:

(a) To provide for an attachment point from the foot to the racquet.

(b) To provide a stable kicking surface from which to launch a more controlled kick of a round ball or an uneven footbag surface.

(c) To provide for action/play with any ball whether specifically designed for play with a foot racquet or not.

(d) To provide for any style of shoe for attachment, such as where the shoe has standard shoelaces.

(e) To provide no other attachment necessary for play.

(f) To provide a vinyl sheath as a kicking surface with Drist brand rivets attached for durability and stability should one or more elastic bands break during play. The attached drawings show a continuous elastic band. The invention may also include the attachment of the vinyl sheath to the elastic materials that can make adjustments for different levels of player skill levels.

(g) To provide a lower skill level for players that do not possess the physical coordination necessary for some types of footbag play.

(h) To provide a training aid for soccer players.

(i) To provide a physical fitness device for use by coaches and Physical Education Instructors seeking to improve foot eye coordination.

(j) To provide a straight kicking motion similar to American National Football League kicking style. This acts to reduce injuries from the awkward side motion of hackey sack kick play.

(k) To provide for a longer and stronger kick when kicked dead center of the target area.

(l) To make the sport of Footbag a field sport that can now utilize a much larger and more dynamic field of play.

(m) To provide for a more sensitive feel to the kick.

(n) To provide a more controlled kick and deliver a footbag to a pre-described target with less effort.

(o) To provide a suitable high speed indoor/arena style sporting environment.

In addition to the above, the invention works towards providing an additional avenue for a sporting event for young people to engage their energy. The lack of interest and the recent fall off in popularity of footbags will be revived through the use and promotion of this device. The need for large numbers of players is reduced. Wherever the foot racquet invention is used, it will provide an additional way to enjoy a sunny day at the park, beach or under the dim light of a street lamp on a hot summer night.

In accordance with an embodiment of the foot racquet invention that works towards enchancing the kicking action of a standard ball or footbag, the foot racquet attaches via shoelaces in a crisscross fashion to a standard tennis shoe. This arrangement works to solve the problem of where a human foot does not have an opposing thumb style appendage which enables a human being to grasp and use a racquet for use by the foot and leg.

BRIEF DESCRIPTION OF THE DRAWING

FIG. 1 shows a top view of the foot racquet frame with the vinyl sheath and initial design elastic band 41 tached.

FIG. 2 shows the aluminum frame only.

FIG. 3 shows a side view 90 degree flip straight down from FIG. 2

FIG. 4 show a side view 90 degree flip to the side from FIG. 2.

Figure 5:
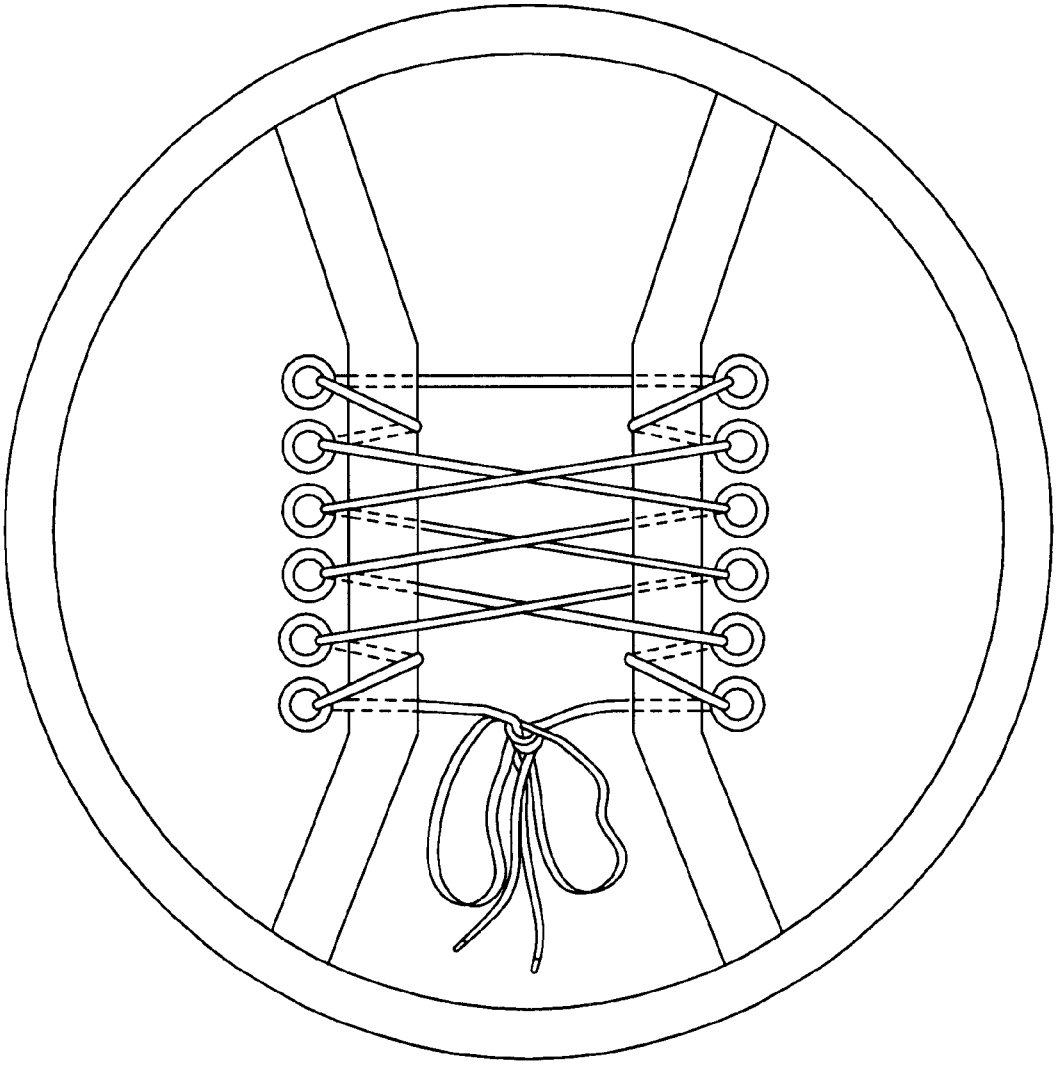
FIG. 5 shows a proposed lacing structure that ensures a safe and stable attachment to a laceable tennis style shoe.

Reference Numerals In Drawings: The simplicity of this design requires no numeric numbering to explain.

DETAILED DESCRIPTION OF THE INVENTION

The main frame consists of aluminum. 5½ inches (") interior diameter aluminum pipe cut in ¼" slices for working prototypes. The resulting rings were welded to ¼" thick tempered aluminum tubes which were cut in 7" sections and bent to the dimensions shown in the figures. The resultant pieces were welded by a tungsten and inert gas welding technique. Future models may be plastic injection molded or forged aluminum. Future production models will be manufactured from a material that will not chip, crack or fracture.

The vinyl sheaths were die cut and assembled with Drist Brand eyelets for structural integrity at the point of elastic attachment to the racquet frame.

There are various designs for attaching, the shoe to the racquet such as a simple strap or a Velcro attachment which can be designed into a custom shoe. Additionally, the rubber materials used may change with technology and have already changed with prototypes developed since the effective filing date of this patent.

Current designs of the invention utilize small rubber bands encased in vinyl cloth material similar to small bungee cords or girls hair ties, connected by an "e" clip used in the hobby industry to attach the propellers of model airplanes. The frame listed in FIG. 1 as aluminum can also be made of a variety of high grade metals of plastics. Future designs call for a rubber sheath similar to condom material which is vulcanized to either a vinyl or other suitable material to serve as the sheath for function and style.

From the description above the following advantages become evident:

a). Less skilled players can participate in a sport largely dominated by highly skilled in soccer style play.

b). A more controlled kick can be achieved from more advanced players.

c). A higher or longer kick can also realized—up to 150 feet (').

d). The platform is durable enough so as to not to pose a health threat due to breakage or other fracturing of the frame itself.

e). The sheath provides a flat surface for which to aim for and kick from.

f). Many advanced players will find the touch and feel of the kicking surface appealing from a centered kick upon the "sweet spot".

In operation, a ball may be struck such as by kicking with the invention. Preferably, the ball is kicked as close as possible to the center of the racquet vinyl sheath to provide a trampoline effect which propels a ball or other footbag style projectile into the air in a more controlled play and kicking action. The kick motion and action is similar to that of a punter in a National Football League (NFL) American style football game except that the ball is kicked either straight up into the air or to another player on the field.

Figure 6A:
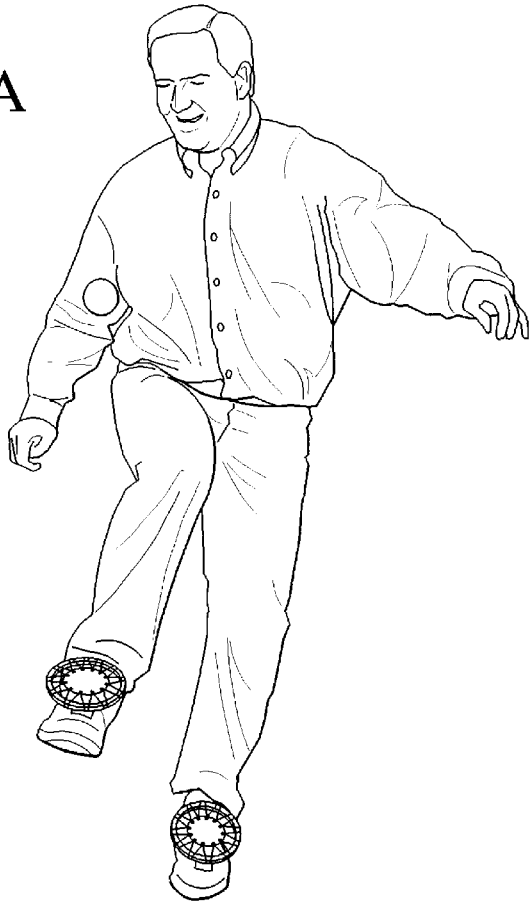
FIG. 6A shows an isometric front view of a projectile in play with a foot racquet on each shoe.
Figure 6B:
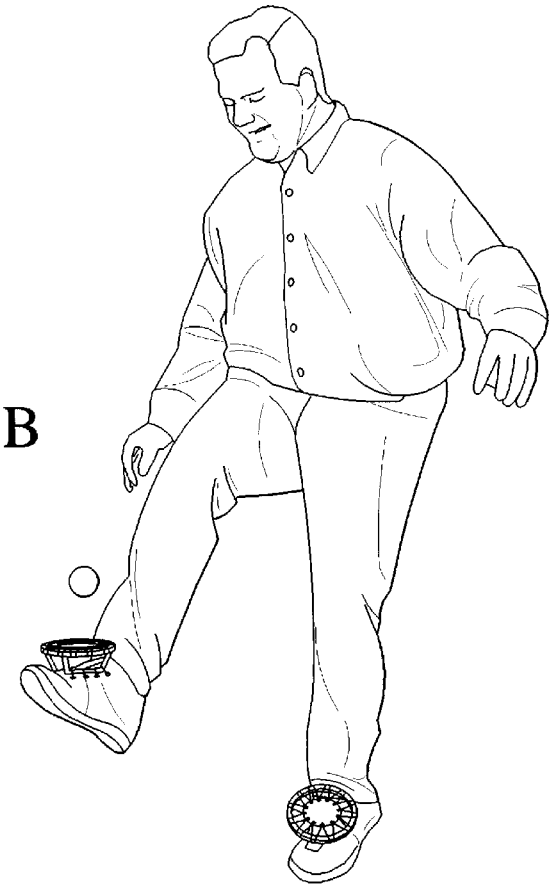
FIG. 6B shows a skewed side view of the projectile of FIG. 6B returning towards the foot racquet.
Figure 6C:
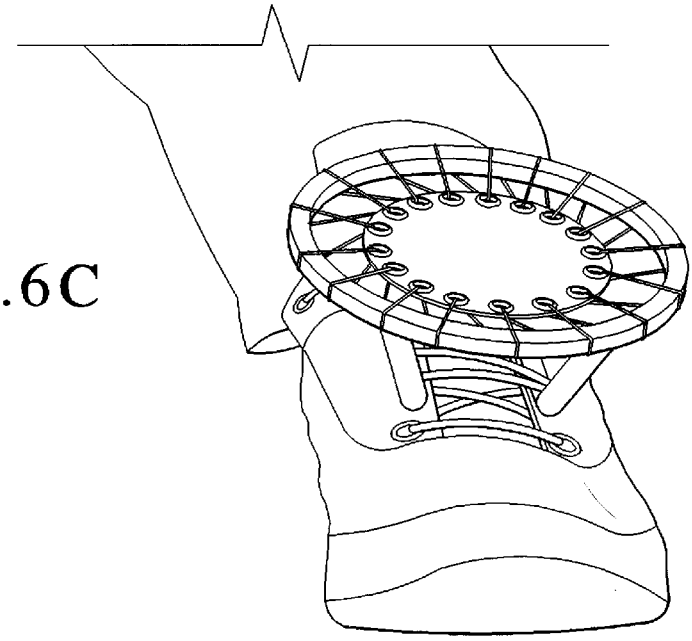
FIG. 6C shows a front isometric view of an installation of a foot device to strike a projectile.
Figure 6D:
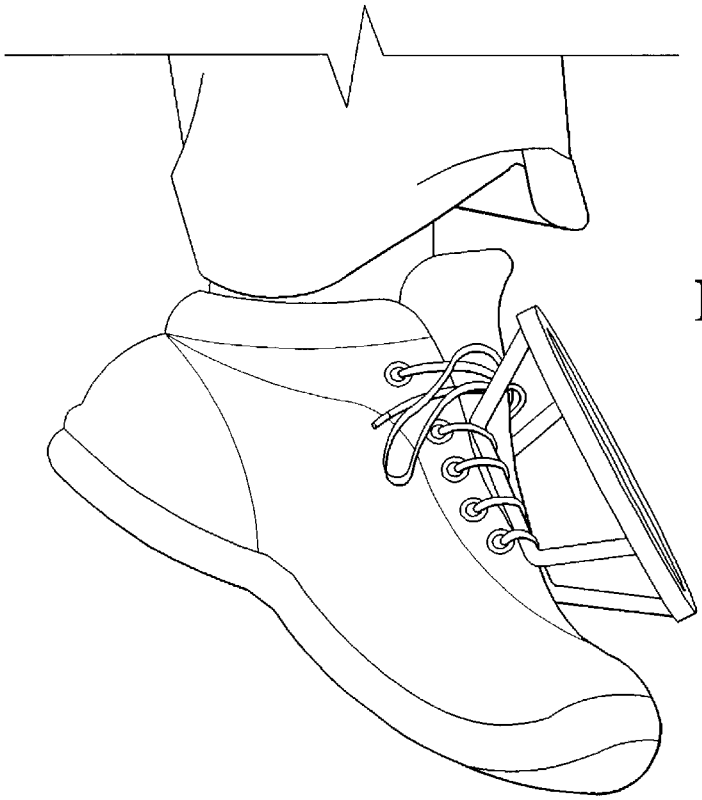
FIG. 6D shows an skewed side view of the foot device of FIG. 6C.

As seen in FIGS. 6A though 6D, the foot racquet may be use with any ball. The racquet will find a home with foot bag players seeking a more dynamic kicking surface. The touch, control, and feel of the foot racquet provides a more confident toe kick for distance. The racquet also allows less skilled players to participate in the sport "Hacky Sack."

The soccer ball "dribbling" (kicking a ball straight up in the air multiple times) is difficult to master. Soccer players will find a game employing the invention a pleasing game since the foot racquet can be used to develop soccer skills and eye foot coordination in general.

Advantages of the invention include a low production cost, wide application since there are 1,200,000 current foot bag players in the United States and over 5,000,000 foot bag players worldwide. The foot racquet may be marketed via the Internet and initially marketed through foot bag clubs internationally.

The invention may include a foot racquet utility design that allows for a person to kick a ball or footbag whereby the player can exercise more distance and control than would otherwise be made without such a device. The invention may be used in a situation where a human foot is physically incapable of grasping a foot racquet device without the aid of shoelaces or other utility device serving as an attachment to the foot as described in the specification. Moreover, the racquet may be used with any type of ball whether designed specifically for the foot racquet or not. This is whereby the racquet may be packaged and sold in concert as a footbag kit with another ball which may or may not be specifically stated as a use for the ball used.

The attachment of the racquet to the shoe enables a player to grasp and attach the racquet indirecctly to the leg and foot whereby the racquet renders itself useful to a player. Any such attachment of the racquet to the foot that may include Velcro straps. Moreover, any such attachment to the shoe which incorporates a shoe that is custom designed for the purpose of utilizing any type of foot racquet utility design. Further any such attachment to a shoe may utilizes simple clamps or attachments of any kind.

The invention also includes a rubber designed to project a ball into the air via a "mini-trampoline" design. The aluminum or plastic framing material may be attached via clips to the rubber band/elastic materials or other elastic band material providing a reflexive effect such that the elastic material is adapted to strike a projectile and to extend while exerting tension on the frame. The reflexive effect may cause a ball to gain momentum and speed from the point of contact on a center or sweet spot of the sheath/pad. The mini-trampoline may employ future materials, regardless of the origin, which would cause the ball to operate in a more controlled forceful or powerful manner.

The invention may also employ a more solid or stable material for the elastic banding material currently being fulfilled by an elastic, but may in the future be used with standard string materials woven and used by tennis or racquetball hand racquets.

The foot racquet of the invention may be designed for use/play with a ball or foot bag. The foot racquet provides for a stable kicking surface from which to launch a more controlled kick of a round ball or multi-paneled footbag. The foot racquet is designed for use with a human leg and foot. Due to physical nature of a human foot, there is no appendage to grasp any sort of object by the toes or feet. This foot racquet design relies upon an innovative way of attachment by lacing the racquet to the foot in a fashion described in connection with FIG. 5.

Primarily designed for use with a footbag or small solid ball, the foot racquet uses a mini-trampoline design to propel an object into the air much further and with more control than by the side of the foot or any part of a leg by itself. This provides advantages to the feel, control, and distance of kicking a projectile. The design allows for a rubberized material around the circumference of the racquet frame for the intended play/action.

The foot racquet may act as a training aid for soccer players and may provide a physical fitness device for use by Coaches and Physical Education Instructors seeking to improve foot eye coordination. The kicking action may be similar to American National Football League kicking style. This acts to reduce injuries from the awkward side motion of footbag kick play.

As discussed in the provisional patent application filed in connection with this patent, the game of kicking a small foot bag has become an American sport of leisure for many young men and women between the ages of 10 and 25. The skills required for play are difficult to master. These skills require very well developed full body, foot, and leg coordination to actively participate. Play is repetitious and monotonous. Many players lose interest in the game after only a few sessions. This new custom-designed foot racquet toy may be use with a foot bag or other sports ball. The foot racquet works towards increasing the action of the sport. The racquet also lowers the skill level needed to actively participate in the sport of kicking a foot bag or other sports ball designed for play. This sports toy may be a racquet style mini-trampoline designed for attachment via shoelaces to a tennis shoe. The racquet allows for a more controlled kick action and allows a player to project a ball or foot bag further than with a conventional shoe kicking action.

Play is designed for use with many varieties of foot bags or sports balls. The use of this foot racquet is not exclusively limited to balls or foot bags, commonly known as "Hacky Sack" which is owned by The Whammo Company and previously held by Mattel, Inc. The style of attachment of the foot racquet may be to the foot to project balls or other toys from the feet. This invention, while initially designed for use with a foot bag, may be used with any sports ball which will provide enhanced play from its use.

The foot racquet may be attached to a standard tennis style shoe. The scope of the invention includes all rights to this game/sport and any shoe design attempting practice the invention for any particular brand of shoe designed for use with a kick bean bag, or other ball kicked by use of a mini-trampoline/foot racquet design.

In one embodiment, holes may be cut in the Sheath/Center Pad and "Drist" brand eyelets placed along the perimeter to lace rubber band/elastic material from the leather sheath to the aluminum frame which is designed to act as a raised mini trampoline. A round frame may be mounted to the shoe by laces and the holes in the shoe as permitted through an undercarriage designed to mount, the frame on top of the foot. This may create a flat surface upon which to strike the foot bag when kicked in a forward kicking motion similar to a soccer goal scoring motion or American National Football League Football field goal kick. The rubber band may be disposed from the aluminum frame to the leather sheath.

Different embodiments for different player skill levels are contemplated as a function of the kick distance desired and accuracy required for participation in future organized sporting events. The mini-trampoline or foot racquet design may be attached to a player's foot by looping and interlacing the shoe laces onto the attached design. Please refer to FIG. 7, FIG. 8, and FIG. 9 for the proposed attachment.

Figure 7:
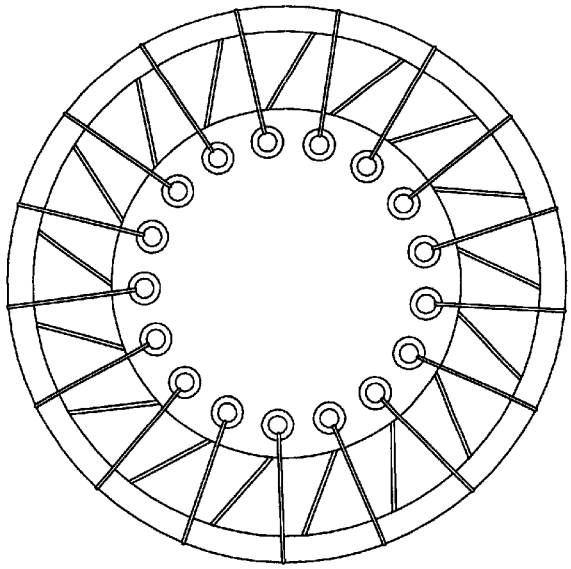
FIG. 7 shows an embodiment of the mini-trampoline design of the invention.

In one embodiment, a mini-trampoline design allows the player to more accurately play with a foot bag or other ball with a considerable increase in the distance of shots/plays. As seen in FIG. 7, the design may include the following:

- a frame having a 5 inch interior diameter;
- a sheath having a 3.1 inch exterior diameter;
- the frame being aluminum and having a round cross section defining a ⅛ inch diameter;
- elastamer material disposed between the frame and the sheath.

In one embodiment, holes may be cut in a leather sheath and "Drist" brand eyelets may be arranged to permit lacing of rubber band material from the leather sheath to the aluminum frame, the arrangement of which may be designed to act as a raised mini trampoline. The round frame may be mounted to the shoe by laces and the holes in the shoe as permitted through an undercarriage designed to mount the frame on top of the foot.

This may create a flat surface upon which to launch the foot bag when kicked in a forward kicking motion similar to a soccer goal scoring motion or American NFL Football field goal kick. The rubber band from the aluminum frame to the leather sheath may have more or fewer holes spanning from the frame to the leather sheath, depending on how skilled the player is. There may be different designs for different player skill levels based upon the kick distance desired and accuracy required for participation in future organized sporting events.

Figure 8:
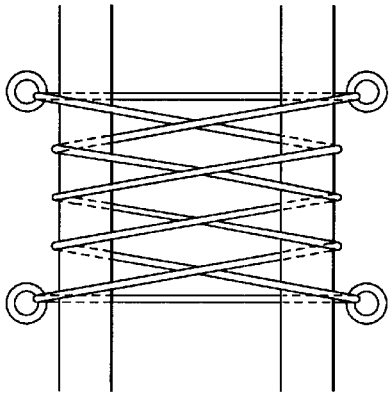
FIG. 8 shows an installation of the frame into shoelaces.
Figure 9:
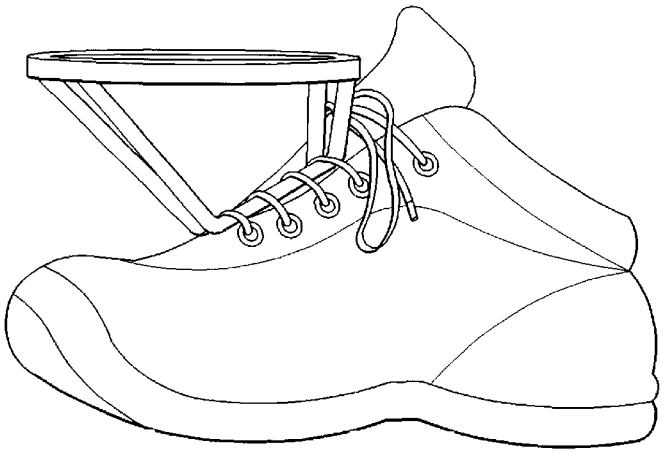
FIG. 9 shows a side view of a foot racquet installed into a tennis shoe.

The mini-trampoline or foot racquet design may be attached to a players foot by interlacing the shoe laces onto the attached design such as seen in FIG. 8 and FIG. 9. Also included within the scope of this invention are the rights for the rubber plastic attachments and the method for attachment.

FIG. 8 shows a top view of an attachment of an aluminum frame to a tennis shoe. A twist in the shoelace creates a loop as an attachment abutment to the tennis shoe. In the side view of FIG. 9, a circular foot racquet made of aluminum is shown attached to a tennis shoe at a position elevated above the shoe.

The foot racquet provides a stable kicking surface from which to launch a more controlled kick of a round ball or an uneven slightly round panel footbag. Provide for play with any ball whether specifically designed for play with a foot racquet or not. No specially designed ball is required for play/action. Provides for any style of shoe for attachment, particularly where the shoe has standard shoelaces. No other attachment or accessory is necessary for play.

A vinyl sheath acts as a kicking surface with Drist brand rivets attached for durability and stability should one or more elastic bands break during play. The brand names used are for further understanding and does not limit the claims made to specific brands or types of rivets or other materials stated herein. The attached drawings show a continuous elastic band. Alternate elastic materials that can make adjustments for different levels of player skill levels may be used. The invention also provides a lower skill level for players that do not possess the physical coordination necessary for some types of footbag play.

The invention can act as a training aid for soccer players. Also provides a physical fitness device for use by coaches and Physical Education Instructors seeking to improve foot eye coordination. Kicking action is similar to American National Football League kicking style. This acts to reduce injuries from the awkward side motion of hackey sack kick play. Provide a longer and stronger kick when kicked dead center of the target area. Finally this invention makes the sport of Footbag a field sport that can now utilize a much larger and more dynamic field of play. Provides for a more sensitive feel to the kick and offers a more controlled kick to deliver a footbag to a pre-described target with less effort. Can also provide a suitable high speed indoor/arena style sporting environment.

The color combinations and styles can be too numerous to mention here. The patent holder reserves the right to license all future designs that employ the claimed invention for attachment to the shoe via a lace simple strap or other strap style attachment to a custom made shoe.

While various embodiments of the invention have been described, it will be apparent to those of ordinary skill in the art that many more embodiments and implementations are possible that are within the scope of this invention. Accordingly, the invention is not to be restricted except in light of the attached claims and their equivalents.

What is claimed is:

1. A foot device to strike a projectile, the foot device comprising:

a frame;

an elastic material coupled to the frame, wherein the elastic material is adapted to strike the projectile and to extend while exerting tension on the frame; and a base coupled to the frame, wherein the base includes at least one bar comprising a first end coupled to a first position on the frame and a second end coupled to a second position on the frame, wherein the at least one bar is adapted to receive a shoe lace of a standard laceable tennis shoe.

2. The foot device of claim 1, wherein the frame defines a circular cross section in a plane that is parallel with the elastic material.

3. The foot device of claim 1, wherein the elastic material includes a sheath coupled to at least one elastic banding.

4. The foot device of claim 3, wherein the sheath includes a plurality of eyelets, wherein the at least one elastic banding is disposed through one of the eyelets.

5. The foot device of claim 3, wherein the sheath includes a first position and a second position, wherein the sheath is flat in the first position and disposed between the frame and the base in the second position, and wherein the plurality of eyelets are symmetrically distributed about the sheath.

6. The foot device of claim 1, wherein the at least one bar is made of aluminum.

7. The foot device of claim 6, wherein the at least one bar is two bars disposed at an acute angle to each other.

8. In the game of footbag, a foot device to strike a footbag, the foot device comprising:

a frame;

an elastic material coupled to the frame, wherein the elastic material is adapted to strike the footbag and to extend while exerting tension on the frame; and a base coupled to the frame, wherein the base includes at least one bar comprising a first end coupled to a first position on the frame and a second end coupled to a second position on the frame, wherein the at least one bar is adapted to receive a shoe lace of a standard laceable tennis shoe.

9. The foot device of claim 8, wherein the frame defines a circular cross section in a plane that is parallel with the elastic material.

10. The foot device of claim 8, wherein the elastic material includes a sheath coupled to at least one elastic banding.

11. The foot device of claim 10, wherein the sheath includes a plurality of eyelets, wherein the at least one elastic banding is disposed through one of the eyelets.

12. The foot device of claim 10, wherein the sheath includes a first position and a second position, wherein the sheath is flat in the first position and disposed between the frame and the base in the second position, and wherein the plurality of eyelets are symmetrically distributed about the sheath.

13. The foot device of claim 8, wherein the at least one bar is made of aluminum.

14. The foot device of claim 13, wherein the at least one bar is two bars disposed at an acute angle to each other.

15. A foot device kit, comprising:

at least one projectile;

a foot device to strike the projectile, the foot device comprising a frame, an elastic material coupled to the frame, wherein the elastic material is adapted to strike the projectile and to extend while exerting tension on the frame, and a base coupled to the frame; and a packaging disposed with respect to the at least one projectile and the foot device, wherein the base includes at least one bar comprising a first end coupled to a first position on the frame and a second end coupled to a second position on the frame, wherein the at least one bar is adapted to receive a shoe lace of a standard laceable tennis shoe.

16. The foot device kit of claim 15, wherein the at least one projectile is a footbag and the packaging is disposed about the at least one footbag and the foot device.

17. The foot device kit of claim 15, wherein the elastic material includes a sheath coupled to at least one elastic banding.

18. The foot device kit of claim 17, wherein the sheath includes a plurality of eyelets, wherein the at least one elastic banding is disposed through one of the eyelets.

19. The foot device kit of claim 17, wherein the sheath includes a first position and a second position, wherein the sheath is flat in the first position and disposed between the frame and the base in the second position, and wherein the plurality of eyelets are symmetrically distributed about the sheath.

20. The foot device kit of claim 15, wherein the at least one bar is made of aluminum.

* * * * *